US005174542A

United States Patent [19]

DeLeeuw, Jr.

[11] Patent Number: 5,174,542

[45] Date of Patent: Dec. 29, 1992

[54] SECURE MOUNT FOR TROLLING MOTOR

[76] Inventor: William D. DeLeeuw, Jr., 131 Maple Dr., Mankato, Minn. 56001

[21] Appl. No.: 652,787

[22] Filed: Feb. 8, 1991

[51] Int. Cl.[5] ..... B63B 17/00

[52] U.S. Cl. ..... 248/640; 248/552; 248/222.1; 248/225.1; 248/223.4; 70/58

[58] Field of Search ..... 248/640-643, 248/551-553, 222.1, 223.4, 224.1, 224.2, 225.1; 70/58

[56] References Cited

U.S. PATENT DOCUMENTS

| | | | |
|---|---|---|---|
| 2,680,000 | 6/1954 | Pulver | 248/222.1 X |
| 2,858,690 | 11/1958 | Sanderson et al. | 70/58 |
| 2,992,551 | 7/1961 | Cleveland | 70/58 |
| 3,003,733 | 10/1961 | Peterson | 248/273.4 |
| 3,061,250 | 10/1962 | Conover | 248/222.1 X |
| 3,319,060 | 5/1967 | Bartley | 248/222.1 X |
| 3,750,988 | 8/1973 | Lyon | 248/641 |
| 3,822,049 | 7/1974 | Saunders | 248/225.1 |
| 4,047,686 | 9/1977 | Porter | 248/552 |
| 4,094,482 | 6/1978 | Weaver | 248/4 |
| 4,129,088 | 12/1978 | Foley, Jr. | 115/18 |
| 4,149,691 | 4/1979 | Moeser | 248/642 |
| 4,154,417 | 5/1979 | Foley, Jr. | 248/640 |
| 4,176,580 | 12/1979 | Gallegos | 248/224.1 |
| 4,432,527 | 2/1984 | Sample | 248/548 |
| 4,535,521 | 10/1986 | Webb | 248/551 X |
| 4,658,607 | 4/1987 | Muse, Jr. et al. | 70/164 |
| 4,682,960 | 7/1987 | Hendrickson | 440/53 |

OTHER PUBLICATIONS

"Removable Trolling Motor Bracket" brochure, T. C. Sales, Blaine, Minn., undated.

*Primary Examiner*—Alvin C. Chin-Shue
*Attorney, Agent, or Firm*—John W. Bunch

[57] ABSTRACT

An improved mount (10) for securing a trolling motor to a boat includes a slide plate (16), base plate (22), stop (28, 30), and a thumbscrew (32). If desired, the mount (10) can be positively secured with a lock (34) against possible unauthorized removal or theft.

16 Claims, 2 Drawing Sheets

SECURE MOUNT FOR TROLLING MOTOR

TECHNICAL FIELD

The present invention relates generally to a mount for an outboard motor on a boat. More particularly, this invention concerns a mount for selectively securing an electric trolling motor against unauthorized removal or theft.

BACKGROUND ART

Electric trolling motors are typically used in conjuction with another primary power source, such as an outboard motor, for propulsion and maneuvering at slow speeds at a desired fishing site, for example. Trolling motors can also be used as the primary power source on a small recreational boat or a canoe, but more often are used as a secondary power source on a fishing boat because of their quiet operational characteritics. Various such trolling motors have been available heretofore. Some are adapted for mounting on the transom while others are adapted for mounting on the bow of a boat, and most are usually adapted for convenient placement into or out of the water as desired when mounted so as not to interfere with operation of the boat when not in use. Trolling motors are typically steered by hand, however, more recently trolling motors have become available which are steered by means of a remote foot pedal so that the operator's hands are free for casting, etc. while fishing. Such trolling motors are available from MinnKota Corporation of Mankato, Minn.

In the past, such controlling motors haven been secured by means of either permanent or releasable mounts. A releasable mount of course offers the advantage of convenience, but leaves the motor exposed to unauthorized removal or theft. Trolling motors are generally of lightweight, compact construction and some models are relatively expensive, particularly the remote control models. As a result, it is often necessary to romove and stow the trolling motor in a secure place between uses of the boat and even while the boat is on a trailer and hitched to a car or truck, but unattended. Permanent mounts offer better security, but are awkward and difficult to use when preparing the boat for storage at the end of one fishing season or preparing it for use at the beginning of another. A need has thus arisen for an improved mount for selectively securing a trolling motor against unauthorized use or theft.

SUMMARY OF THE INVENTION

The present invention comprises an improved trolling motor mount which overcomes the foregoing and other difficulties associated with the prior art. In accordance with the invention, there is provided a mount by which a trolling motor can be removably attached to a boat, and secured thereon if desired. The mount herein includes a slide plate which is secured to the motor and adapted for sliding receipt by a base plate secured to the boat. Stop means are provided for locating the plates in the desired relative position, after which they can be locked against separation in order to deter possible unauthorized removal or theft of the motor.

BRIEF DESCRIPTION OF DRAWING

A better understanding of the invention can be had by reference to the following Detailed Description in conjunction with the accompanying Drawing, wherein.

DETAILED DESCRIPTION

Figure 1:
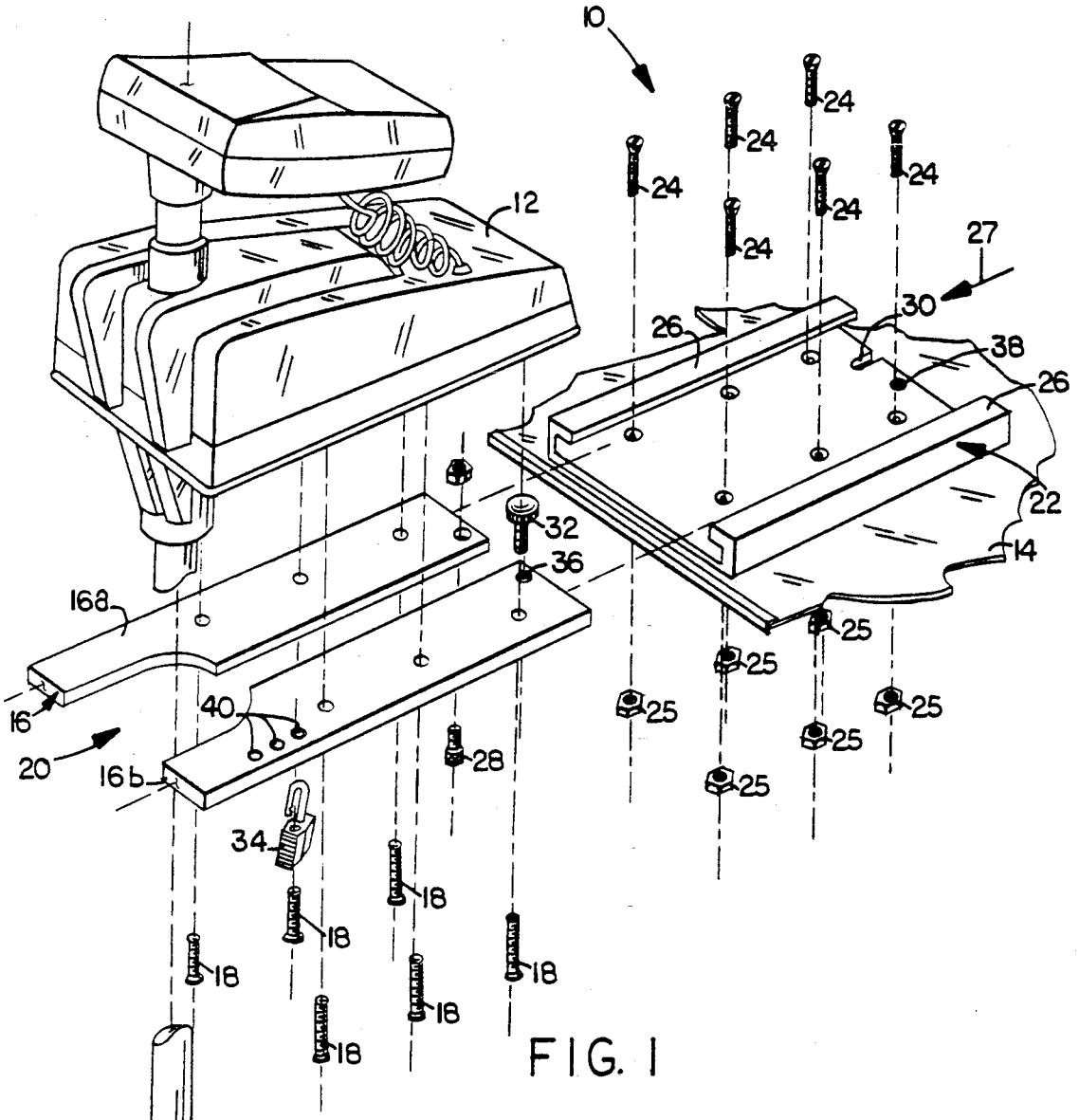
FIG. 1 is an exploded perspective view of a trolling motor mount incorporating a first embodiment of the invention.
Figure 2:
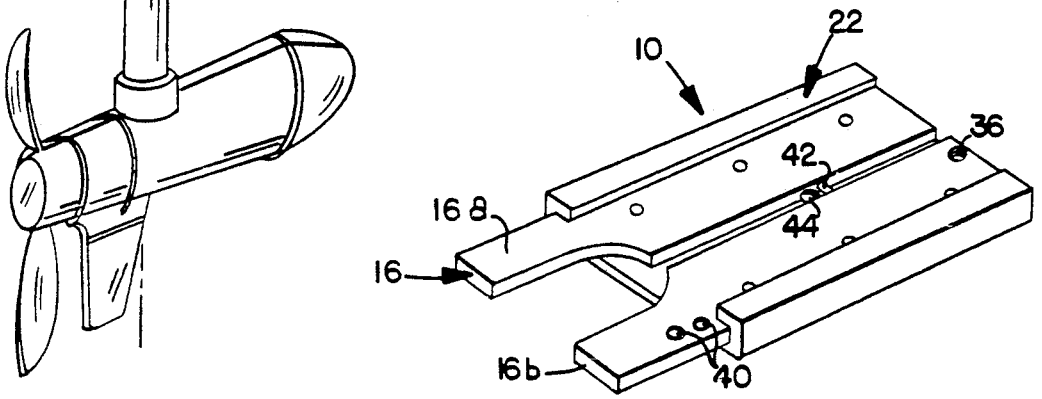
FIG. 2 is perspective view showing the base plate with the slide plate therein.

Referring now to the Drawing, wherein like reference numerals designate like or corresponding elements throughout the views, and particularly referring to FIGS. 1 and 2, there is shown a mount 10 for securing a trolling motor 12 to a boat 14. As will be explained more fully hereinafter, the mount 10 provides for convenient removal and attachment of the motor 12 to the boat 14, while at the same time allowing the motor when attached to be secured against possible unauthorized removal or theft.

The mount 10 includes a slide plate 16 which is secured to the underside of the motor 12 by means of fasteners 18. As shown, the plate 16 is of split construction comprising portions **16*a* and 16*b*, although a single plate can be used. The fasteners 18 preferably extend upwardly through holes in the plate 16, which are preferably countersunk on the underside of the plate so that the heads of the fasteners are flush. Suitable flat head screws or bolts can be used for fasteners 18. An opening 20 is provided at one end of plate 16 as shown for receipt of the shaft of motor 12**, which can be lifted, lowered or tilted in order to position the motor into or out of the water as desired.

The mount 10 also includes a base plate 22 that is secured to boat 14 by fasteners 24, which preferably comprise flat head bolts or screws and nuts 25. The fasteners 24 extend downwardly through holes in the base plate 22 which are countersunk as illustrated similar to the holes in the plate 16 so that the heads of the fasteners are flush. The base plate 22 includes opposing rails 26 to define a slide way for plate 16.

Plates 16 and 22 are preferably formed of metal, such as aluminum.

After attachment to the motor 12, the plate 16 and motor thereon are inserted into the base plate 22 in the direction indicated by arrow 27 until the protruding head of bolt 28 on plate 16 engages a notch 30 in the end of the base plate 22. Bolt 28 and notch 30 thus function as a stop in order to locate plates 16 and 22 in the desired relative position, after which they can be secured against separation by a thumbscrew 32 or a lock 34. When so located, the heads of fasteners 18 and 24 are hidden between plates 16 and 22, and thus cannot be removed. The thumbscrew 32 extends downwardly through a hole 36 near the protruding end of plate 16 and into a corresponding threaded hole 38 near the corresponding end of base plate 22. Depending upon the available clearance, the lock 34 can be inserted through one of the holes 40 in plate 16 so as to prevent it from being removed from base plate 22 with motor 12. The lock 34 can be of the key or combination type having a movable shackle.

FIG. 2. shows a modification of the mount 10 incorporating a different stop arrangement. Instead of bolt 28 and notch 30 as shown in FIG. 1, a cross pin 42 interconnecting the two portions 16*a* and 16*b* of plate 16 can be used together with a round head screw 44 secured to the base plate 22. Other suitable stop arrangements may be used.

Figure 3:
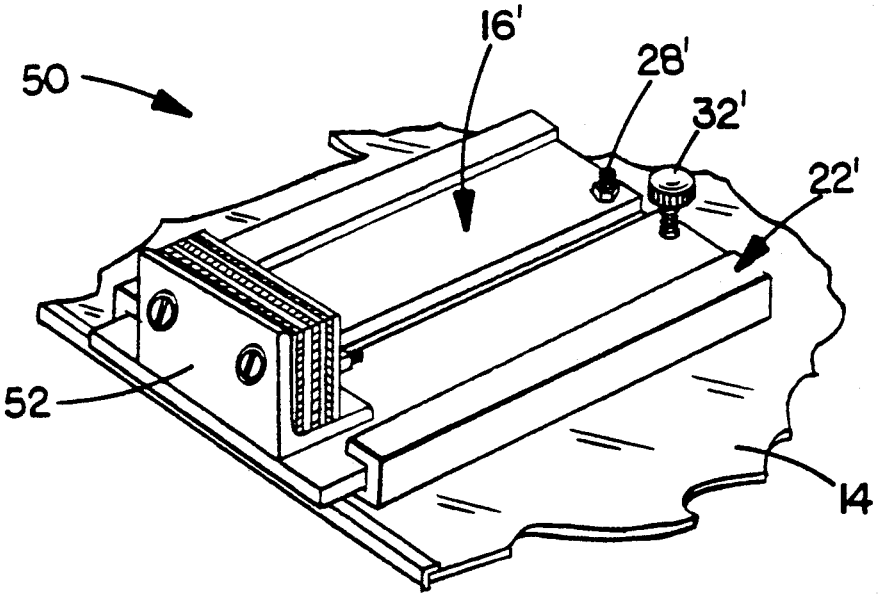
FIG. 3 is a perspective view of a trolling motor mount incorporating a second embodiment of the invention.

Referring now to FIG. 3, there is shown a trolling motor mount 50 incorporating a second embodiment of the invention. The mount 50 incorporates several components which are substantially identical in construction and function to components of the mount 10. The same reference numerals have been utilized to identify such components, except with prime (') notations for differentiation. The mount 50 incorporates a split slide plate 16' and a base plate 22' which are located in relative sliding position by a nut 26' and secured in place with a prime screw 32'. The primary distinction between the two embodiments is that the mount 50 includes an angle 52 secured to one end of the slide plate 16' so that a trolling motor (not shown) with a transom mount can also be used on the bow of boat 14. Since trolling motors of this type are typically held in place with screws and can thus be readily removed from the mount, a lock is unnecessary.

From the foregoing, it will thus be apparent that the present invention comprises an improved trolling motor mount having several advantages over the prior art. The mount herein allows for convenient mounting of a trolling motor on a boat, while at the same time allowing it to be secured against possible unauthorized removal or theft. Other advantages will be evident to those skilled in the art.

Although particular embodiments of the invention have been illustrated in the accompanying Drawing and described in the foregoing Detailed Description, it will be understood that the invention is not limited only to the embodiments disclosed, but is intended to embrace any alternatives, equivalents, modifications and/or rearrangements of elements falling within the scope of the invention as defined by the following claims.

What is claimed is:

1. In combination with a trolling motor and a boat, a mount for securing the trolling motor to the boat, which comprises:

a slide plate;

means for securing said slide plate to the trolling motor;

said means for securing said slide plate including a plurality of threaded fasteners extending upwardly through countersunk holes in said slide plate and into the trolling motor;

a base plate defining a slideway for receiving said slide plate;

means for securing said base plate to the boat;

stop means for limiting relative sliding movement between said slide plate and said base plate in one direction; and removable lock means for positively securing said slide plate against relative sliding movement in the other direction and disengagement and separation from said base plate.

2. The trolling motor mount of claim 1, wherein said slide plate and said base plate are each generally flat, and are of different relative lengths.

3. The trolling motor mount according to claim 2, wherein said lock means extends through a hole in the relatively longer one of said slide and base plates in order to releasably secure said plates against separation.

4. The trolling motor mount according to claim 2, wherein said slide plate and said base plate are each formed of metal.

5. The trolling motor mount of claim 1, wherein said means for securing said base plate includes a plurality of threaded fasteners extending downwardly through countersunk holes in said base plate into the boat.

6. The trolling motor mount of claim 1, wherein said removable lock means extends through a hole in at least one of said slide and base plates, the hole being located so that said lock means would interfere with the other plate, in order to positively secure said plates against separation.

7. The trolling motor mount of claim 1, further including:

a thumb screw for threaded engagement with registerable holes in said slide plate and said base plate.

8. In combination with a trolling motor and a boat, a mount for securing the trolling motor to the boat, which comprises:

a generally flat slide plate;

means extending through said slide plate for securing said slide plate to the trolling motor;

a generally flat base plate including oposing inwardly turned side edges defining a slideway there between for receiving said slide plate in order to connect said plates;

means extending through said base plate for securing said base plate to the boat;

stop means for limiting relative sliding movement between said slide plate and said base plate in one direction;

a thumb screw for threaded engagement with registerable holes in said slide plate and said base plate in order to releasably secure said plates against relative sliding movement; and removable lock means for positively securing said slide plate against relative sliding movement in the other direction and disconnection from said base plate;

said means for securing said slide plate and said means for securing said base plate being located so as to be inacessible when said plates are connected.

9. The trolling motor mount of calaim 8, wherein said slide plate and said base plate are each generally rectangular, and are of different relative lengths.

10. The trolling motor mount according to claim 9, wherein said removable lock means extends through a hole in only the relatively longer one of said slide and base plates.

11. The trolling motor according to claim 9, wherein said slide and base plates are each formed of metal.

12. The trolling motor mount of claim 9, wherein said means for securing said base plate includes a plurality of threaded fasteners extending downwardly through countersunk holes in said base plate and into the boat.

13. The trolling motor mount of claim 9, wherein said means for securing said slide plate includes a plurality of threaded fasteners extending upwardly through countersunk holes in said slide plate and into the trolling motor.

14. The trolling motor mount of claim 9, wherein said removable lock means comprises a padlock.

15. In combination with a trolling motor and a boat, a mount for securing the trolling motor against unauthorized removal from the boat, which comprises:

a generally flat slide plate;

first fasteners extending upwardly through said slide plate for securing said slide plate to the trolling motor;

a generally flat base plate including opposing inwardly turned side edges defining a slideway therebetween for receiving said slide plate in order to connect said plates;

second fasteners extending downwardly through said base plate for securing said base plate to the boat;

said slide and base plates each being generally rectangular, but of different relative lengths;

stop means for limiting relative sliding movement between said slide plate and said base plate in one direction; and removable lock means for extension through a hole in only the relatively longer one of said slide and base plates, the hole being located so that said lock means would interfere with the other plate, in order to positively secure said plates against disconnection, said first and second fasteners being located so as to be inacessable when said slide and base plates are connected.

16. The trolling motor amount of claim 15, further including: a thumb screw for threaded engagement with registrable holes in said slide plate and said base plate in order to releasably secure said plates against relative sliding movement.

* * * * *